US008350476B2

(12) United States Patent
Ishikawa et al.

(10) Patent No.: US 8,350,476 B2
(45) Date of Patent: Jan. 8, 2013

(54) SHORT ARC TYPE DISCHARGE LAMP

(75) Inventors: Hirohisa Ishikawa, Hyogo (JP); Hiroyoshi Kitano, Hyogo (JP); Nobuhiro Nagamachi, Hyogo (JP); Toyohiko Kumada, Hyogo (JP); Takashi Yamashita, Hyogo (JP); Michiko Morooka, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/565,870

(22) Filed: Sep. 24, 2009

(65) Prior Publication Data

US 2010/0079048 A1 Apr. 1, 2010

(30) Foreign Application Priority Data

Oct. 1, 2008 (JP) ..... 2008-256249

(51) Int. Cl.
*H01J 17/16* (2012.01)

(52) U.S. Cl. ..... 313/634

(58) Field of Classification Search ..... 313/634, 313/635

See application file for complete search history.

(56) References Cited

U.S. PATENT DOCUMENTS

| | | | | |
|---|---|---|---|---|
| 6,960,884 | B2 | 11/2005 | Arimoto et al. | |
| 2003/0020403 | A1 * | 1/2003 | Okubo et al. | 313/574 |
| 2003/0201719 | A1 * | 10/2003 | Ikeuchi et al. | 313/631 |
| 2008/0185950 | A1 * | 8/2008 | Claus et al. | 313/267 |

FOREIGN PATENT DOCUMENTS

| | | | | |
|---|---|---|---|---|
| JP | 54-132975 | U | | 9/1979 |
| JP | 06-267502 | A | | 9/1994 |
| JP | 2004039496 | A | * | 2/2004 |
| JP | 2005-216514 | A | | 8/2005 |
| JP | 2006-179421 | A | | 7/2006 |

* cited by examiner

*Primary Examiner* — Anh Mai
*Assistant Examiner* — Hana Featherly
(74) *Attorney, Agent, or Firm* — Rader, Fishman & Grauer PLLC

(57) ABSTRACT

A short arc type discharge lamp comprises a pair of electrodes, at least one of which has an electrode main body portion and an axis portion and/or a taper portion formed between the electrode main body portion and the axis portion, wherein in the at least one of the electrodes, the axis portion has an outer diameter smaller than that of the electrode main body portion, and at least one groove extending in an axis line direction of the electrode is formed in the electrode main body portion, the axis portion or the taper portion.

4 Claims, 15 Drawing Sheets

SHORT ARC TYPE DISCHARGE LAMP

CROSS-REFERENCES TO RELATED APPLICATION

This application claims priority from Japanese Patent Application Serial No. 2008-256249 filed Oct. 1, 2008, the contents of which are incorporated herein by reference in its entirety.

TECHNICAL FIELD

The present invention generally relates to a short arc type discharge lamp, and specifically relates to a short arc type discharge lamp, which is a light source for a liquid crystal display apparatus or a projector apparatus such as a DLP (Digital Light Processor) using a DMD (Digital Mirror Device).

BACKGROUND

A projector apparatus is required to uniformly project an image with sufficient color rendering property to a rectangle screen. Therefore, 0.15 mg/mm$^3$ of mercury is enclosed in an arc tube of a light source for such a projector apparatus, and a short arc type discharge lamp (hereinafter also referred to merely a lamp) in which the mercury vapor pressure in the arc tube turns into 150 or more atmospheric pressure at time of lighting, is used therefor.

FIG. 14 is a schematic view of the structure of a conventional short arc type discharge lamp. In an arc tube thereof, 0.15 mg/mm$^3$ of mercury and rare gas containing halogen are enclosed. A pair of electrodes 2 made of tungsten is arranged to face each other therein. Sealing portions 3 are formed, extending from the arc tube. Metallic foils 4 are buried in the respective sealing portions 4. External leads 5 are connected to the respective metallic foils 4. Each of the electrodes 2 is formed by winding a coil around a rod member made of tungsten, and then melting only a tip side portion of the coil. That is, a tip side portion of the electrode is formed as a lump by melting the coil, and a back end side thereof stays in the coil shape. This kind of electrodes is disclosed in Japanese Patent Application Publication No. 2005-19262.

In a short arc type discharge lamp having such electrodes, electric discharge changes from mercury arc discharge, to glow discharge, and from the glow discharge to arc discharge in that order. Description thereof will be given below referring to FIG. 14. A first stage of the electric discharge is the mercury arc discharge which begins at the mercury adhering to the electrodes 2 and 2. Although this mercury arc discharge is maintained until the mercury adhering to the electrodes is blown away therefrom, the electrodes 2 and 2 are not heated to a temperature sufficient for thermionic emission in the mercury arc discharge. In addition, there is no such an initial stage of the electric discharge in case of a short arc type discharge lamp which does not contain mercury. A second stage of the electric discharge is the glow discharge. During this glow discharge, these electrodes are heated by collisions of cations of rare gas and those of mercury. When these electrodes 2 are heated to the temperature at which thermionic emission becomes possible by the glow discharge, the electric discharge shifts from the glow discharge to arc discharge. When these electrodes include portions which tend to be easily heated at the time of glow discharge, these portions are preferentially heated so as to emit thermal electrons, whereby it is possible to smoothly make transition from the glow discharge to the arc discharge. Coil portions 2*a* are formed on the electrodes 2 shown in an FIG. 14, in order to make the portions heated preferentially. The third stage of the electric discharge is the arc discharge. Since the tip portions of the electrodes 2 are lower in temperature than the coil portions 2*a* immediately after the electric discharge shifts to the arc discharge, a coil arc discharge which begins at these coil portions 2*a* is performed. After the temperature of the tip portions of these electrodes 2 rises due to heat transfer from the respective coil portions 2*a*, the arc discharge which begins at the tip portions of the electrode 2 is performed.

SUMMARY

In the short arc type discharge lamp having the electrode structure shown in FIG. 14, the coil portions 2*a* formed at back end portions of the respective electrodes are heated during the glow discharge, thereby easily becoming a high temperature state. For this reason, it is believed that it is possible to promptly make transition from the glow discharge to the coil arc discharge which begins at the coil portions 2*a*.

However, in the above-mentioned short arc type discharge lamp, the transition time from the glow discharge to the coil arc discharge is not necessarily sufficiently short. For this reason, the base portions of the electrodes are heated with arc, so that electrode structure material which is evaporated from the electrode base portions adheres to a wall of the arc tube. Therefore, it is not possible to avoid a problem that a base portion of the arc tube is blackened. In recent years, miniaturization of projector apparatus is progressing, so that miniaturization of the short arc type discharge lamp installed therein is also strongly demanded by projector manufactures etc. Therefore, the inner diameter of an arc tube is made small as much as possible according to the demand. Such a structural arrangement, in which the electrodes are provided close to a wall of the arc tube, assists the blackening of the base portion of the arc tube. Although, by separating the electrodes from the wall of the arc tube by some distance, it is possible to prevent the electrode structure material which is evaporated from the electrode base portions from adhering to the wall of the arc tube, such a measure cannot be adopted because of the above-mentioned reason.

In view of the above background, it is an object of the present invention to prevent blackening of a base portion of an arc tube, by shortening a period during which the electrode base portion is heated with arc.

One of the aspect of the present invention is a short arc type discharge lamp comprising a pair of electrodes, at least one of which has an electrode main body portion and an axis portion, wherein in the at least one of the electrodes, the axis portion has an outer diameter smaller than that of the electrode main body portion, and a groove(s) extending in an axis line direction of the electrode is formed in the electrode main body portion. In such a structure, the groove(s) is heated at time of glow discharge due to the hollow effect produced by the grooves provided in the main body portion of the electrode. Therefore, it becomes easy for arc discharge to move toward a tip portion of the electrode, along the grooves. Therefore, it is possible to certainly prevent the base portion of the arc tube from blackening.

Another aspect of the present invention is a short arc type discharge lamp comprising a pair of electrodes, at least one of which has an electrode main body portion, an axis portion and a taper portion which is formed between the electrode main body portion and the axis portion, wherein in the at least one of the electrodes, the axis portion has an outer diameter smaller than that of the electrode main body portion, as an outer diameter of the taper portion becomes gradually smaller from a side of the electrode main body portion toward a side of the axis portion, and a groove extending in an axis line direction of the electrode is formed in the taper portion. In such a structure, since the hollow effect exerts due to the groove(s) formed in the taper portion, and electric discharge moves to the tip portion of the electrode through the grooves formed on the taper portion, which is located near a base portion of the electrode, electric discharge at the base portion can be suppressed so that it is possible to shorten time required to make transition from the glow discharge to arc discharge.

Still another aspect of the present invention is a short arc type discharge lamp comprising a pair of electrodes, at least one of which has an electrode main body portion and an axis portion, wherein in the at least one of the electrodes, the axis portion has an outer diameter smaller than that of the electrode main body portion, and a groove extending in an axis line direction of the electrode is formed in the axis portion. In such a structure, since the hollow effect arises due to the groove(s) formed in the axis portion, and electric discharge moves toward a tip portion of the electrode through the groove(s) of the axis portion located near a base portion of the electrode, electric discharge at the base portion can be suppressed so that it is possible to shorten time required to make transition from glow discharge to arc discharge. Moreover, with a temperature rise, it becomes easy for mercury which enters into sealing portions at the time of starting, to move into an arc tube along the groove(s). Therefore, it is possible to suppress breakage of the sealing portions due to internal pressure rise of the mercury enclosed in the sealing portions.

In the short arc type discharge lamp, the groove may be a V-shape in a cross sectional view thereof, taken in a diameter direction of the electrode. In such a case, if the groove(s) which has an arbitrary width is (are) provided, even in case where the pressure or the kind of electric discharge medium enclosed in the arc tube differs, respectively, the width of the groove(s) from which the hollow effect can be optimally obtained, can be suitably set according to the pressure and the kind of each electric discharge medium.

In the short arc type discharge lamp, a heat retention portion may be formed between a pair of the grooves and the heat retention portion is a lemon wedge shape in a cross sectional view thereof, taken in a diameter direction of the electrode. In such a case, most of the outer surface of the heat retention portion is separated from the main body portion of the electrode, whereby, at the time of glow discharge, the heat retention portion becomes tending not to decrease in temperature, so that the heat retention portion can be maintained in a high temperature state. Therefore, it is possible to shorten the time required to make transition from the glow discharge to the arc discharge.

In the short arc type discharge lamp, isolated crystal grains may be formed in both sides of the groove(s). In such a case, since the grains extending in the axis direction of the electrode are formed along the grooves, it is possible to control crystal grain coarsening of the electrode structure material by the groove(s). Therefore, it is possible to prevent the breakage of the electrode at time of transportation of a lamp and lighting thereof.

In the short arc type discharge lamp, the groove(s) may be formed by irradiating the at least one of the electrodes with an energy beam. In such a case, in order to expect the hollow effect, the groove(s) having the optimal pitch and the optimal depth can be manufactured certainly.

BRIEF DESCRIPTION OF DRAWINGS

Other features and advantages of the present short arc type discharge lamp will be apparent from the ensuing description, taken in conjunction with the accompanying drawings, in which.

DETAILED DESCRIPTION

A description will now be given, referring to embodiments of the present short arc type discharge lamp. While the claims are not limited to such embodiments, an appreciation of various aspects of the present short arc type discharge lamp is best gained through a discussion of various examples thereof.

Figure 1:
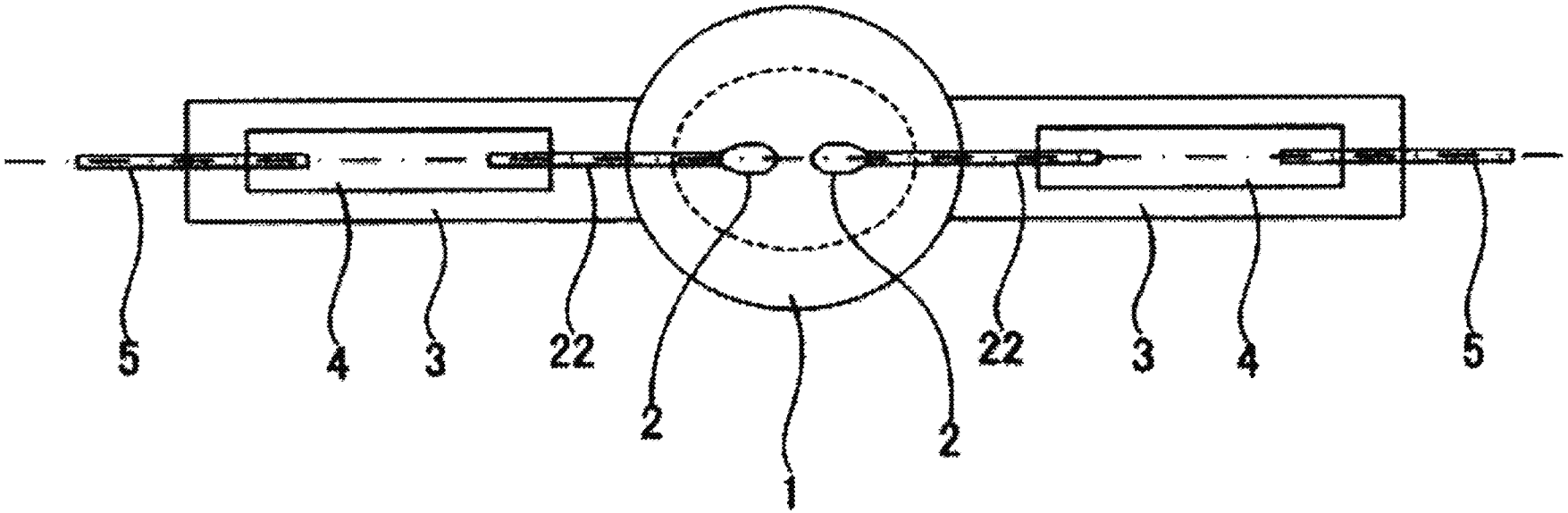
FIG. 1 is a schematic front view of the structure of a short arc type discharge lamp according to the present invention.

FIG. 1 is a schematic front view of the structure of the present short arc type discharge lamp. The short arc type discharge lamp (hereinafter also merely referred to as a lamp) shown in this figure is equipped with an arc tube 1 which is formed approximately in a spherical shape. A pair of electrodes 2 and 2 which face each other is arranged inside the arc tube 1 in which mercury (light-emitting material), halogen gas and rare gas are enclosed. A pair of sealing portions 3 and 3 is continuously extended outward from both ends of the arc tube 1, respectively. Metallic foils 4 for electric conduction, which are made of molybdenum, are airtightly sealed by shrink sealing, inside the respective sealing portions 3 and 3. An axis portion 22 of each electrode 2 is electrically connected with one end section of the metallic foil 4. An external lead 5 for electric supply is connected to the other end section of each metallic foil 4, and extends from an outer end of the sealing portion 3 toward the outside of the sealing portion 3. Electric power is supplied to both the electrodes 2 and 2 of the short arc type discharge lamp through the external leads 5 and 5 and the metallic foils 4 and 4, thereby lighting the discharge lamp with, for example, alternating current.

The mercury, halogen gas, and rare gas are enclosed inside the arc tube 1. The mercury is enclosed to obtain a radiation light of required visible light wavelength, for example, wavelength of 360-780 nm, and 0.15 mg/mm$^3$ or more of mercury is enclosed. Although the amount of mercury to be enclosed varies depending on temperature conditions, the amount is determined so that the vapor pressure of mercury in the arc tube at time of lighting may become 150 or more atmosphere. The vapor pressure of mercury at time of lighting can be increased to 200 atmosphere or more, or 300 atmosphere or more by enclosing more mercury therein. Thus, a light source suitable for a projector apparatus can be made by raising the vapor pressure of mercury. The rare gas such as argon gas, whose amount is, for example, approximately 13 kPa, is enclosed in order to improve a lighting starting performance. The halogen gas is enclosed therein in form of a compound of mercury or other metal with iodine, bromine, chlorine or the like, to achieve longer operating life of the lamp, by using the halogen cycle. The amount of halogen gas to be enclosed is a range of $10^{-6}$ to $10^{-2}$ μmol/mm$^3$.

An example of an embodiment of a short arc type discharge lamp is set forth below. The maximum outer diameter of the light emission section is 9.5 mm, the distance between the electrodes is 1.5 mm, and the internal volume of the arc tube is 3 75 mm. Rated voltage applied thereto is 80 V, and rated power applied thereto is 150 W. Moreover, since the arc tube of the short arc type discharge lamp used for a light source of a projector apparatus is small, the thermal condition in the arc tube 1 becomes very severe. For example, the tube wall load value (input power per unit inner surface area of the arc tube) thereof is 0.8-2.0 W/mm$^2$. The shortest distance between the inner wall of the arc tube and the electrode is 2.0 mm or less in the case of a standard lamp, and may be 1.5 mm or less, or 1.0 mm or less.

First Embodiment

Figure 2A:
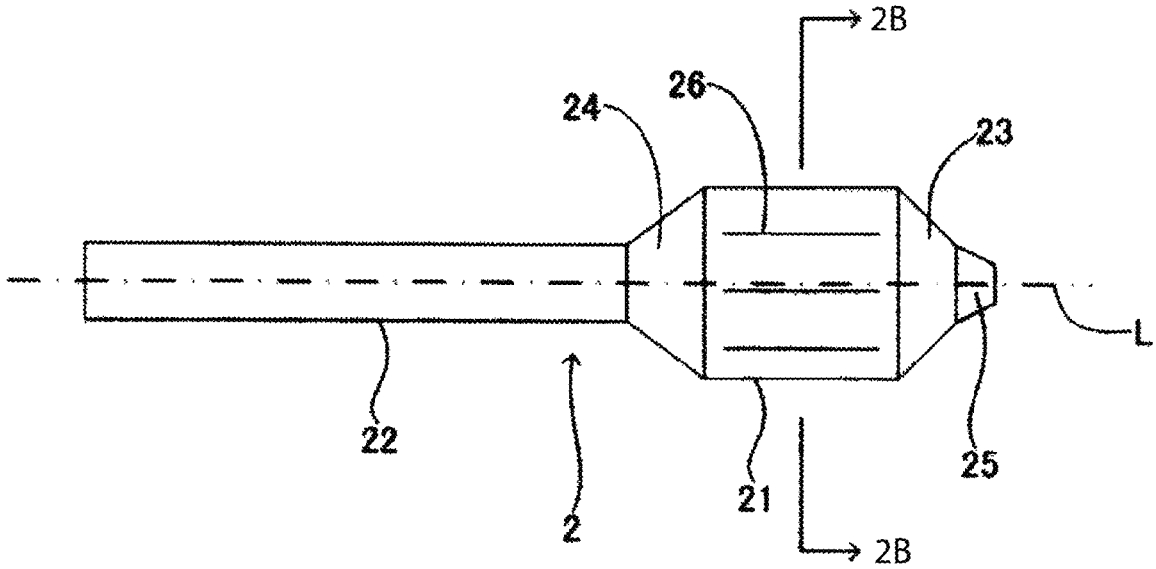
FIG. 2A is a top plan view of an example of an electrode according to a first embodiment of the present invention.
Figure 2B:
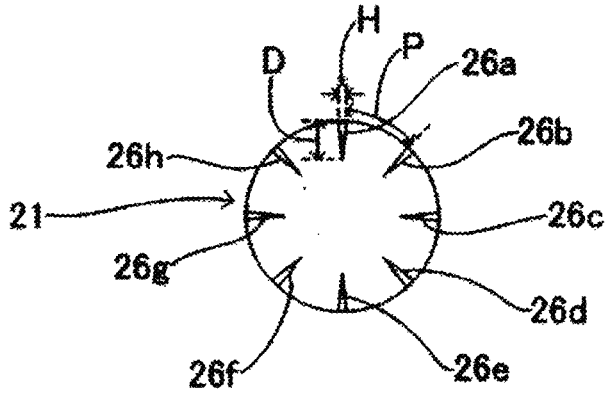
FIG. 2B is a cross sectional view thereof, taken along a line 2B-2B of FIG. 2A.
Figure 2C:
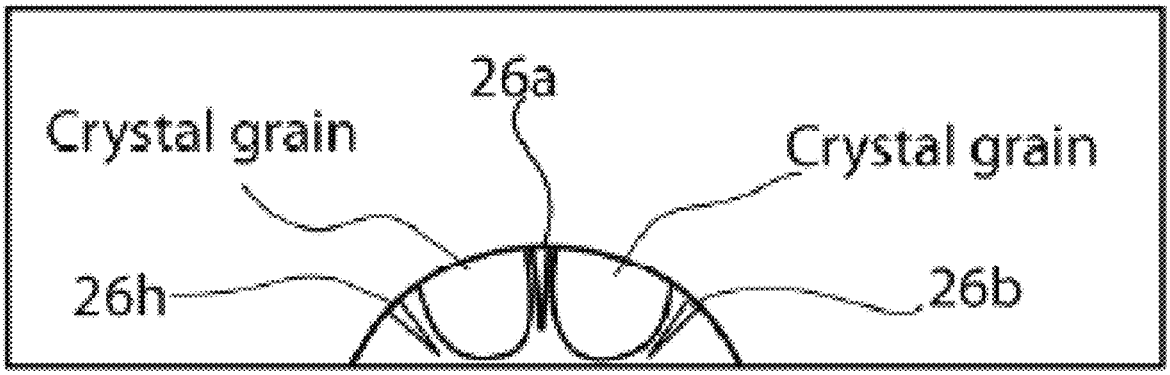
FIG. 2*c* is an enlarged partial view of FIG. 2B.

FIGS. 2A, 2B and 2C show an electrode according to a first embodiment of the present invention. Specifically, FIG. 2A is a top plan view of the electrode, FIG. 2B is a cross sectional view thereof, taken along a line 2B-2B of FIG. 2A and FIG. 2C is an enlarged partial view of FIG. 2B, wherein crystal grains are shown. The electrode 2 has an electrode main body portion 21, and an axis portion 22 with an outer diameter smaller than that of the electrode main body portion 21. A taper portion 23 whose outer diameter becomes gradually smaller with distance from the electrode main body portion 21 is formed on the tip side of the electrode main body portion 21. A projection portion 25 is formed at the tip of this taper portion 23. A taper portion 24 whose outer diameter becomes gradually smaller as it is closer to the axis portion 22 is formed in a base side of the electrode main body portion 21. The axis portion 22 is continuously formed from the base end portion of this taper portion 24.

The electrode main body portion 21, the axis portion 22, the taper portions 23 and 24, and the above-mentioned projection portion 25 are physically integrally made from the same material. For example, it is formed by cutting and processing a rod made from tungsten. The electrode main body portion 21, the axis portion 22, the taper portions 23 and 24, and the projection portion 25 are made from the highly pure tungsten material. It is desirable that the tungsten material with the purity of 4N (99.99%) or more be used therefor.

The taper portion 23 formed on the tip side of the electrode main body portion 21 is in the shape of a truncated-cone as a whole. The outer diameter of the base end portion of the taper portion 23 is equal to the outer diameter of the electrode main body portion 21. The projection portion 25 is in the shape of a truncated-cone or a cylinder shape. In a lamp of alternating current lighting lamp, the projection portion 25 is the highest in temperature in the electrode, in which an arc is formed nearthere. A projection may be naturally formed with progress of lighting time in the lamp in which halogen gas is enclosed, although the projection portion 25 can also be physically integrally formed with the taper portion 23. The taper portion 24 which is formed on the base side of the electrode main body portion 21 is in the shape of a truncated-cone as a whole. The outer diameter of the taper portion 24 on the tip portion thereof is equal to the outer diameter of the electrode main body portion 21, and the outer diameter of a base end portion of the taper portion 24 is equal to the outer diameter of the axis portion 22.

As shown in FIG. 2A, two or more grooves 26, which are apart from each other (one another) and which extend in parallel with an axis line L of the electrode, are formed in the electrode main body portion 21. In the embodiment shown in the figure, each groove 26 is formed only in the electrode main body portion 21, and is not formed in the taper portions 23 and 24. Each groove 26 is in a V-shape in a cross section taken in a diameter direction of the electrode, as shown in FIG. 2B. As shown in FIG. 2B, the grooves 26 are formed to extend radially with respect to the axis (line) L which is a line passing through the center of the electrode, so that a bottom portion of each groove 26 extends toward the center of the electrode.

An example of the electrode according to the first embodiment of the present invention will be described below. The outer diameter of the electrode main body portion 21 is 1.8 mm, the full length of the electrode main body portion 21 is 2.5 mm, the full length of the taper portion 23 is 0.5 mm, the full length of the taper portion 24 is 1 mm, the outer diameter of the axis portion 22 is 0.5 mm, and the full length of the axis portion 22 is 5 mm. The width H of each groove 26 is 10-70 μm (micrometers), the depth D thereof is 20-250 μm (micrometers), and the pitch P thereof is 0.7 mm. Moreover, it is desirable that values of the pitch P and the depth D of the grooves 26 meet the relation of $P/D \geqq 0.5$.

Figure 3A:
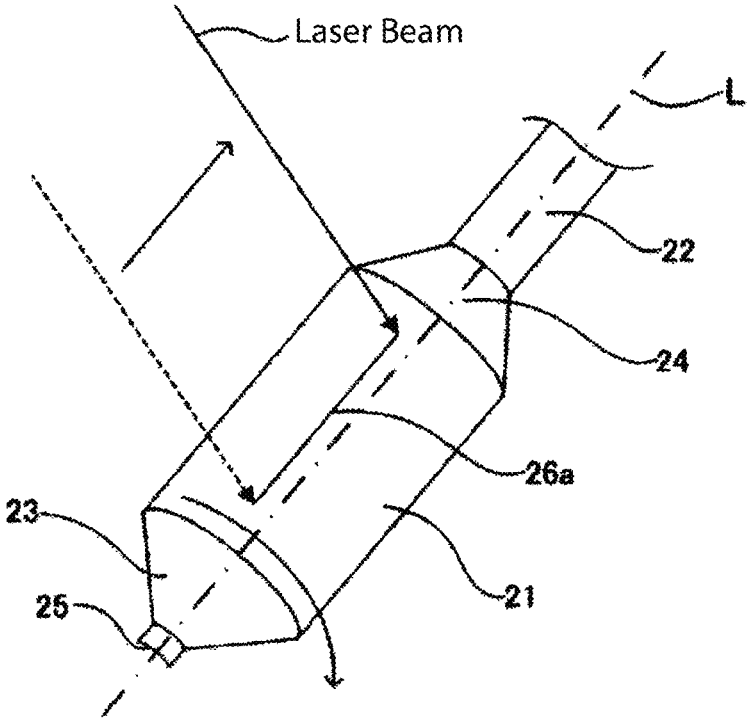
FIGS. 3A and 3B are perspective views showing a manufacture method of a groove(s)
Figure 3B:
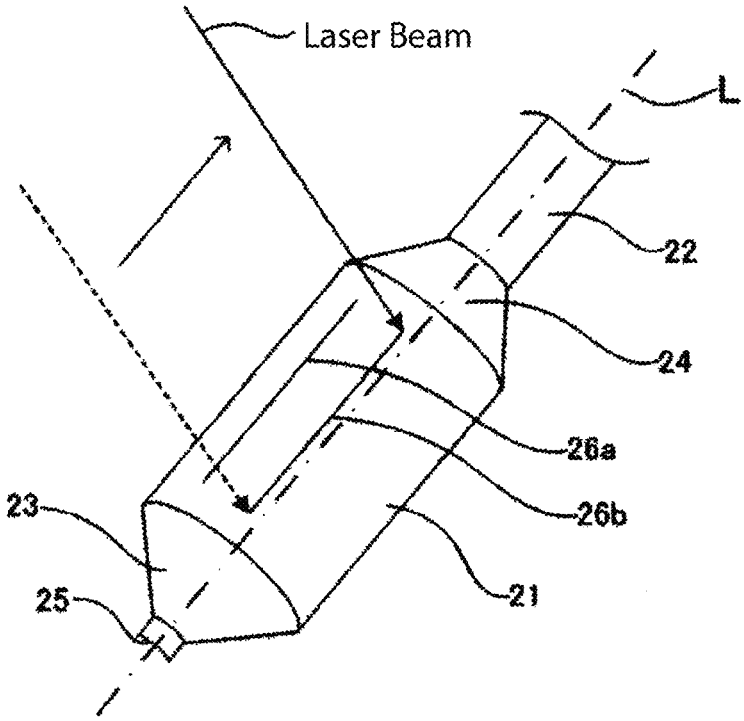

The grooves 26 are formed by irradiating the electrode main body portion 21 with a laser beam. FIGS. 3A and 3B are diagrams showing a manufacture method of the grooves. While scanning the laser beam in a direction of the axis line L of the electrode 2 as shown in FIG. 3A, the electrode main body portion 21 is irradiated with the laser beam, thereby forming a groove 26*a*. After the groove 26*a* is formed, the electrode main body portion 21 is rotated by a predetermined angle in a circumferential direction of the electrode 2 with respect to the axis line L. As shown in FIG. 3B, while scanning a laser beam in the direction of the axis line L of the electrode 2, the electrode main body portion 21 is irradiated with the laser beam, so that a groove 26*b* is formed. By performing this operation one by one, the remaining grooves 26*c* to 26*h* shown in FIG. 2B are formed. The number of the grooves is suitably chosen according to the outer diameter of the electrode main body portion 21, and the width of each groove 26, so that it is not necessary to form them evenly over the electrode main body portion 21 in the circumferential direction. The irradiation conditions of the laser beam are suitably chosen so that the depth of the grooves 26 may be set to, for example, 150 μm (micrometers). Specifically, the fundamental wave frequency thereof is 20 kHz, the average output is 8 W, irradiation time (per groove portion) is 10 to 40 seconds, and the wavelength thereof is 1064 nm. In addition, the groove portion 26 may also be formed by cutting work using a diamond cutter, or irradiation of an electron beam, etc.

In case the electrode 2 produced by the above-mentioned method is made of 4-N material (tungsten purity is 99.99% or more) which is low impurity contents, or 5-N material (tungsten purity is 99.999% or more), or in case the electrode is designed so as to operate at a very high temperature (for example, when it is operated with a high current density which exceeds 0.5 A/mm$^2$), although crystal grains of tungsten tend to grow remarkably at time of lighting of a lamp, when the grooves 26 extending along the axis L are formed in the electrode main body portion 21, the crystal grains are inhibited from growing up in a direction perpendicular to the axis L in the electrode main body portion 21, as shown in FIG. 2C. Namely, when the electrode main body portion 21 has the grooves 26 extending along the axis L, the growth direction of the crystal grains is controlled in the direction of axis L. Therefore, isolated crystal grains are respectively formed at both sides of each groove portion 26 in a cross section, taken in the diameter direction of the electrode main body portion 21, so that it is possible to suppress coarsening of crystal grain. Consequently, it is possible to avoid forming a single grain boundary, orthogonally to the electrode axis. Therefore, the electrode main body portion 21 of the electrode 2 according to the present invention becomes high in rupture strength, so that it is possible to certainly prevent the electrode from being broken due to a decrease of grain boundary. In addition, it is desired that the crystal grains which grow along this axis L, be formed in three or more different directions in view of strength thereof.

In the short arc type discharge lamp according to the present invention, it is possible to shorten time required to make transition of discharge arc from the base portion of the electrode to the tip portion thereof. The reason thereof is not certain but it may be considered as forth below. The hollow effect occurs due to the groove(s) formed in the main body portion 21 of the electrode 2 according to the present invention. The groove(s) becomes easily heated due to the hollow effect over the full length thereof at time of glow discharge. The groove(s) heated at time of glow discharge becomes in a state where thermoelectrons are easily emitted. That is, in the present invention, since the grooves are formed up to a portion near the tip portion of the electrode, a portion where thermoelectrons are easily emitted is formed near the tip portion of the electrode 2. In order to maintain electric discharge with physically minimum energy, the arc discharge tends to move to a portion where it is hot so that thermionic emissions are easily emitted, and an arc discharge distance is shortest. That is, since the grooves extending to near the tip portion of the electrode are formed in the main body portion 21 of the electrode 2 of the short arc type discharge lamp according to the present invention, so that a portion where thermoelectrons are easily emitted, is formed near the electrode tip, time required to make transition of the arc discharge from the base portion of the electrode to the tip portion thereof is remarkably shortened in comparison with an electrode of the prior art.

Figure 4A:
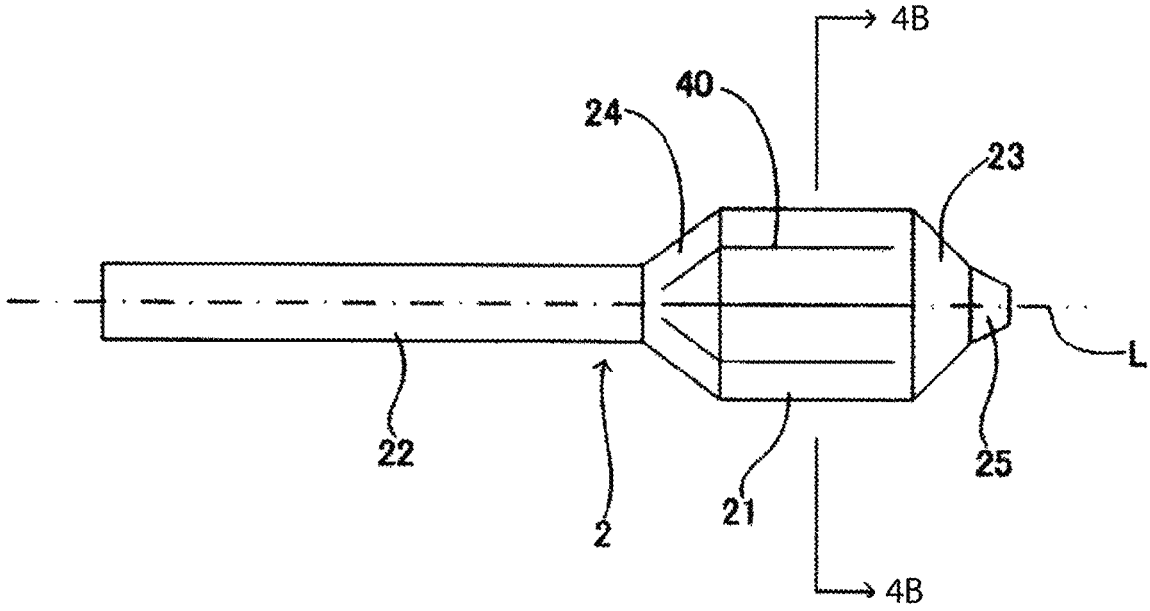
FIG. 4A is a top plan view of another example of an electrode according to the first embodiment of the present invention.
Figure 4B:
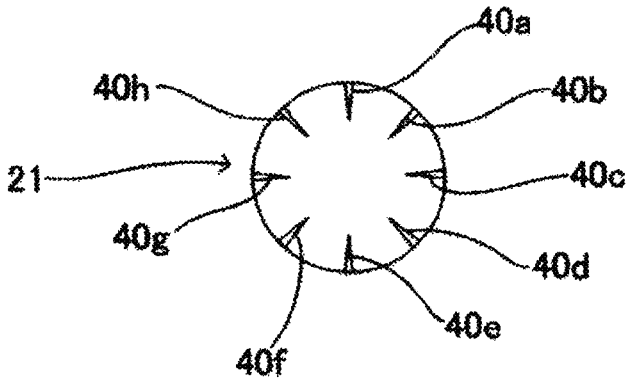
FIG. 4B is a cross sectional view thereof, taken along a line 4B-4B of FIG. 4A.

FIGS. 4A and 4B show another example of an electrode according to the first embodiment of the present invention. Specifically, FIG. 4A is a top plan view of the electrode, and FIG. 4B is a cross sectional view thereof, taken along a line 4B-4B of FIG. 4A. In FIGS. 4A and 4B, the electrode 2 has an electrode main body portion 21, an axis portion 22, taper portions 23 and 24 and a projection portion 25. In the electrode 2 shown in FIG. 4A, two or more grooves 40 which are apart from one another and extend in parallel with an axis L of the electrode 2 are formed in both the electrode main body portion 21 and the taper portion 24 located in the base side of the electrode main body portion 21. Specifically, in the electrode 2 shown in FIG. 4B, eight grooves 40*a*, 40*b*, 40*c*, 40*d*, 40*e*, 40*f*, 40*g*, and 40*h* are formed in both of the electrode main body portion 21 and the taper portion 24.

Figure 5A:
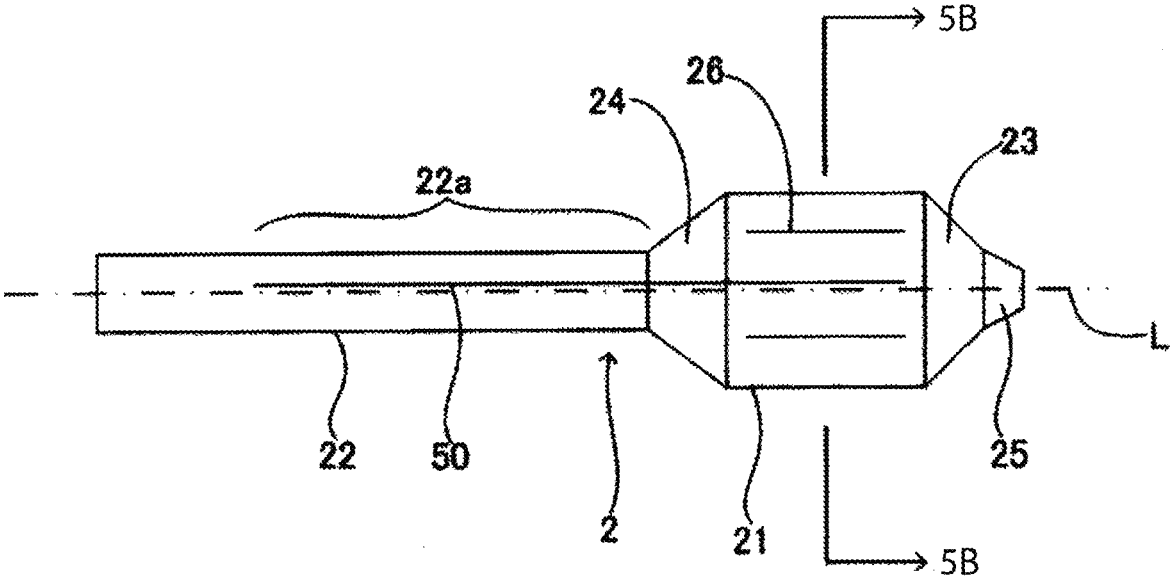
FIG. 5A is a top plan view of still another example of an electrode according to the first embodiment of the present invention.
Figure 5B:
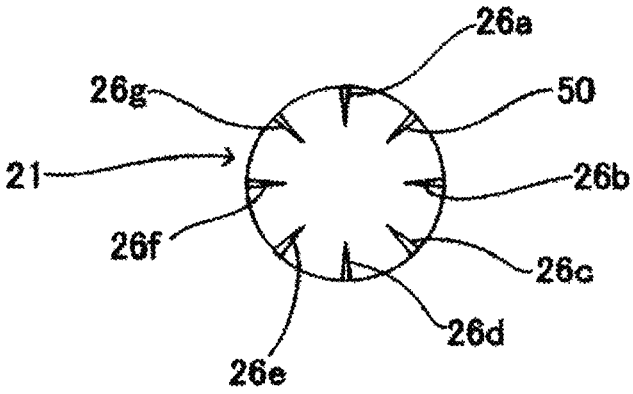
FIG. 5B is a cross sectional view thereof, taken along a line 5B-5B of FIG. 5A.

FIGS. 5A and 5B show another example of an electrode according to the first embodiment of the present invention. FIG. 5A is a top plan view of the electrode, and FIG. 5B is a cross sectional view thereof taken along a line 5B-5B of FIG. 5A. In FIGS. 5A and 5B, the electrode 2 has an electrode main body portion 21 having grooves 26, an axis portion 22, taper portions 23 and 24 and a projection portion 25. As shown in FIG. 5A, the electrode 2 has two or more grooves 26 formed in the electrode main body portion 21, and a groove(s) 50 which has a full length longer than that of the grooves 26 and which is formed over the electrode main body portion 21, the taper portion 24, and the axis portion 22. The groove(s) 50 is formed in a projection portion 22*a* of the axis portion 22, which projects at least in an arc tube 1 so as to extend in parallel with the axis L of the electrode 2. Specifically, as shown in FIG. 5B, the electrode 2 has grooves 26*a*-26*g* formed only in the electrode main body portion 21, and the groove 50 formed in the electrode main body portion 21, the taper portion 24, and the axis portion 22.

Second Embodiment

Figure 6A:
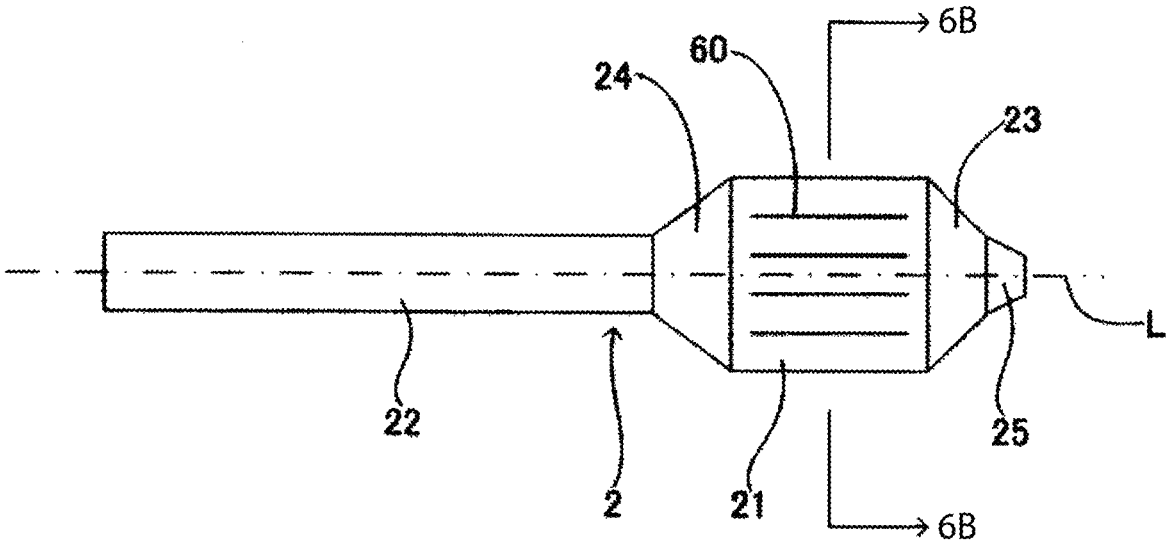
FIG. 6A is a top plan view of an example of an electrode according to a second embodiment of the present invention.
Figure 6B:
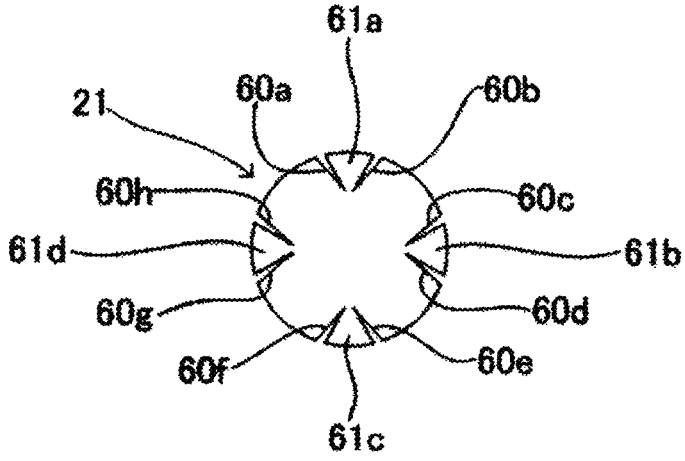
FIG. 6B is a cross sectional view thereof, taken along a line 6B-6B of FIG. 6A.

FIGS. 6A and 6B show an example of an electrode according to a second embodiment of the present invention. FIG. 6A is a top plan view of the electrode, and FIG. 6B is a cross sectional view of the electrode, taken along a line 6B-6B of FIG. 6A. In these figures, the electrode 2 has an electrode main body portion 21, an axis portion 22, taper portions 23 and 24 and a projection portion 25. In the electrode 2 shown in FIG. 6A, two or more grooves 60 which extend in parallel with an axis L of the electrode 2 are formed in the electrode main body portion 21. In FIG. 6B, two or more of pairs of grooves 60 which have an adjacency relationship respectively are formed, wherein each pair of grooves are closer to each other as they extend in an inner and diameter direction in each place. A heat retention portion 61 whose shape is a lemon wedge shape in a cross section taken along the diameter direction, is formed between each pair of adjoining grooves 60. Specifically, in the example of FIG. 6B, grooves 60*a* and 60*b*, grooves 60*c* and 60*d*, grooves 60*e* and 60*f*, and grooves 60*g* and 60*h* are arranged, so that each pair of grooves are closer to each other as they go to the inner and diameter direction of the electrode main body portion 21. A heat retention portion 61*a*, a heat retention portion 61*b*, a heat retention portion 61*c*, a heat retention portion 61*d* are respectively formed between the grooves 60*a* and 60*b*, between the grooves 60*c* and 60*d*, between the grooves 60*e* and 60*f* and between the grooves 60*g* and 60*h*. Each of the heat retention portions 61*a*, 61*b*, 61*c*, and 61*d* are formed at equal intervals in the circumferential direction of a side face of the electrode main body portion 21.

Figure 7A:
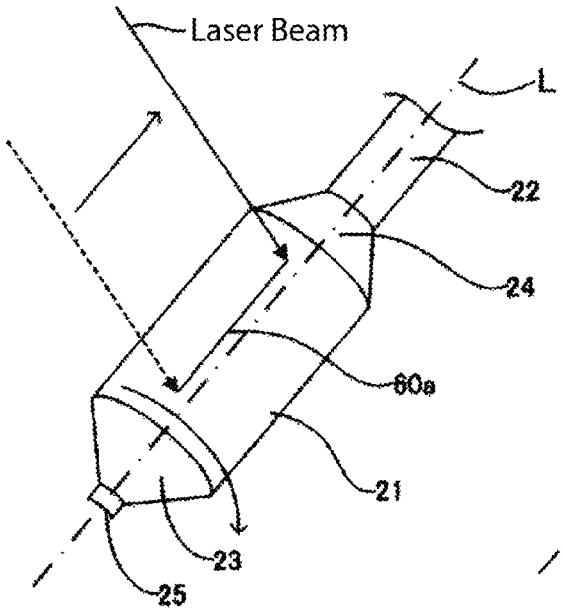
FIGS. 7A-7D are explanatory perspective views showing a manufacture method of a groove portion.
Figure 7C:
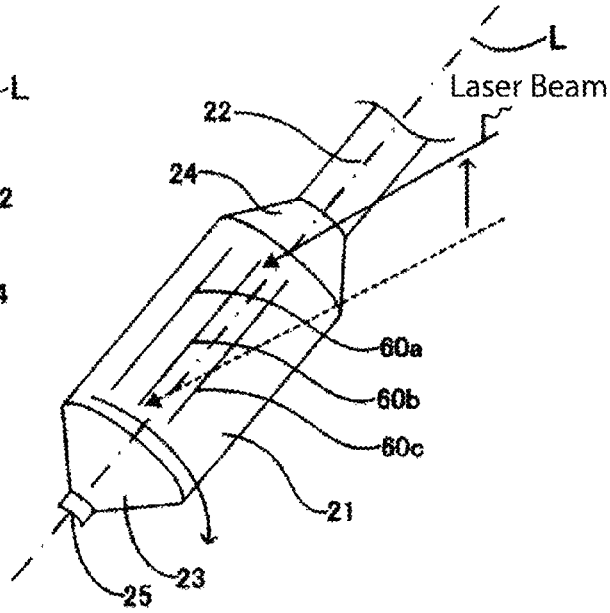
Figure 7B:
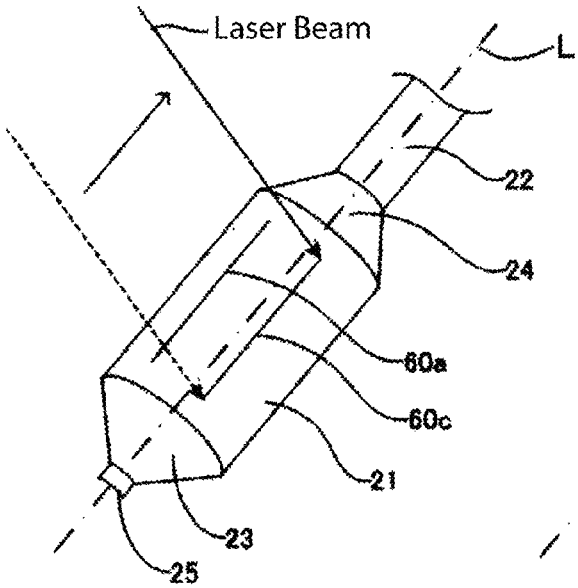
Figure 7D:
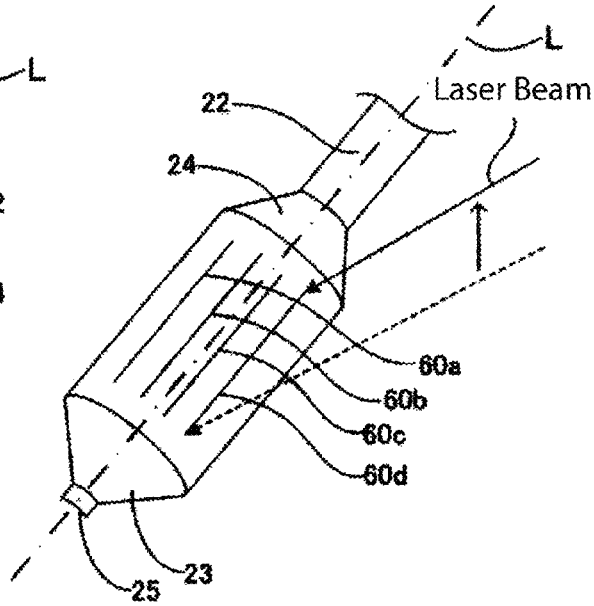

Grooves 60*a*-60*h* are formed by irradiating the axis portion with, for example, a laser beam. FIGS. 7A, 7B, 7C and 7D are explanatory diagrams showing a manufacture method of grooves 60*a*-60*c*. The grooves 60*a*, 60*c*, 60*e*, and 60*g* shown in FIGS. 6A and 6B are formed by irradiating the axis portion with a laser beam obliquely from above the electrode main body portion 21. In detail, as in FIG. 7A, the groove portion 60*a* is formed by scanning and irradiating the electrode main body portion 21 with a laser beam in the direction of an axis L of the electrode main body portion 21. Then, the electrode main body portion 21 is rotated in a circumferential direction by a predetermined angle with respect to the axis line L. As shown in FIG. 7B, the groove 60*c* is formed by scanning and irradiating the electrode main body portion 21 with a laser beam in the direction of the axis L of the electrode main body portion 21. In the same manner, the grooves 60*e* and 60*g* shown in FIG. 6B are formed one by one. Next, the electrode main body portion 21 is obliquely irradiated with a laser beam from above the electrode main body 21*a* but in a direction which is different, by 90 degrees, from the directions at time the grooves 60*a*, 60*c*, 60*e*, and 60*g* are formed, so that the grooves 60*b*, 60*d*, 60*f*, and 60*h* shown in FIG. 6B are formed. In detail, as shown in FIG. 7C, the groove 60*b* is formed by scanning and irradiating the electrode main body portion 21 near the groove portion 60*a*, with a laser beam in the direction of the axis of the electrode main body portion 21. Then, the electrode main body portion 21 is rotated in a circumferential direction by a predetermined angle with respect to the axis line L, and as shown in FIG. 7D, the groove 60*d* is formed by scanning and irradiating the electrode main body portion 21 with a laser beam scan near the groove portion 60*c* in the direction of the axis line of the electrode main body portion 21, the electrode main body portion 21. In the same manner, the grooves 60*f* and 60*h* are formed.

In a short arc type discharge lamp which has such an electrode according to the second embodiment, since the grooves 60*a*-60*h* are formed in the electrode main body portion 21, as in the first embodiment, time required to make transition from glow discharge to arc discharge can be shortened, whereby time spent for heating the electrode base portion is shortened. Therefore, even though the electrode 2 is arranged close to the inner wall of the arc tube 1 due to miniaturization of the arc tube of the short arc type discharge lamp, it is possible to certainly prevent a base portion of the arc tube from blackening. In the electrode according to this embodiment, the heat retention portions 61*a*-61*d* whose shape is a lemon wedge shape in a sectional view taken, along the diameter direction, are respectively formed between adjoining grooves of the electrode main body portion 21, it becomes difficult for the temperature of the electrode main body portion 21 to decrease at time of glow discharge, so that it is possible to shorten time from glow discharge to arc discharge. This is because the heat retention portions 61*a*-61*d* exist most physically independent of the outer surfaces of the electrode main body portion 21, so that it is difficult for heat to be radiated through the electrode main body portion 21 at time of glow discharge.

Figure 8A:
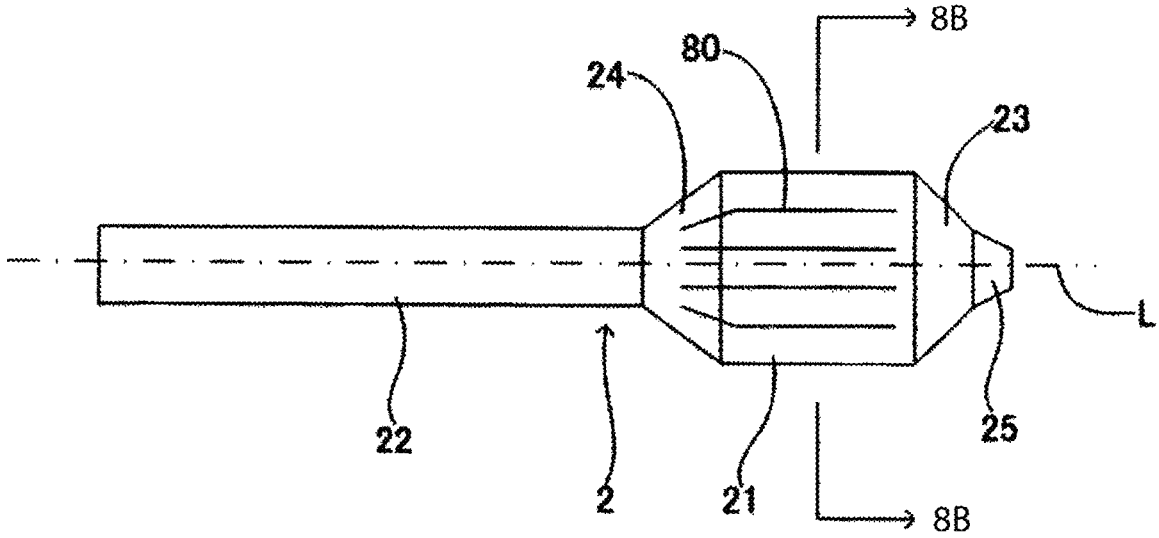
FIG. 8A is a top plan view of another example of an electrode according to the second embodiment of the present invention.
Figure 8B:
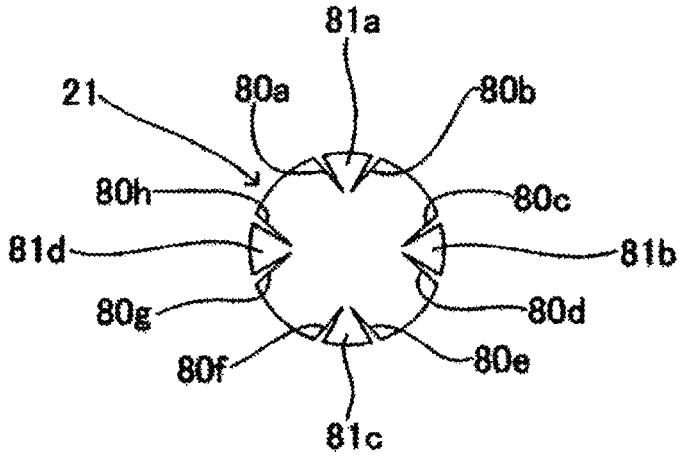
FIG. 8B is a cross sectional view thereof, taken along a line 8B-8B of FIG. 8A.

FIGS. 8A and 8B show another example of an electrode according to the second embodiment of the present invention. FIG. 8A is a top plan view of the electrode, and FIG. 8B is a cross sectional view of the electrode, taken along a line 8B-8B of FIG. 8A. In these figures, the electrode 2 has an electrode main body portion 21, an axis portion 22, taper portions 23 and 24 and a projection portion 25. In the electrode 2 shown in FIG. 8A, two or more grooves 80 which extend in parallel with an axis L of the electrode 2 are formed in both the electrode main body portion 21 and the taper portions 24. In FIG. 8B, two or more pairs of grooves 60 which adjoin respectively are formed, so that paired grooves get closer to each other as they go in an inner and diameter direction in each place. A heat retention portion 81 whose shape is a lemon wedge shape in a cross sectional view thereof, taken along in the diameter direction of the electrode main body portion 21, is formed between each pair of adjoining grooves 80. Specifically, in the example of FIG. 8B, as each pair of grooves 80*a* and 80*b*, grooves 80*c* and 80*d*, grooves 80*e* and 80*f*, and grooves 80*g* and 80*h* extends in the inner and diameter direction of the electrode main body portion 21, the grooves of each pair become closer to each other. A heat retention portion 81*a*, a heat retention portion 81*b*, a heat retention portion 81*c*, a heat retention portion 81*d* are respectively formed between the grooves 80*a* and 80*b*, between the grooves 80*c* and 80*d*, between the grooves 80*e* and 80*f* and between the grooves 80*g* and 80*h*. The heat retention portions 81*a*, 81*b*, 81*c*, and 81*d* are respectively formed at equal intervals in the circumferential direction of a side face of the electrode main body portion 21.

Figure 9A:
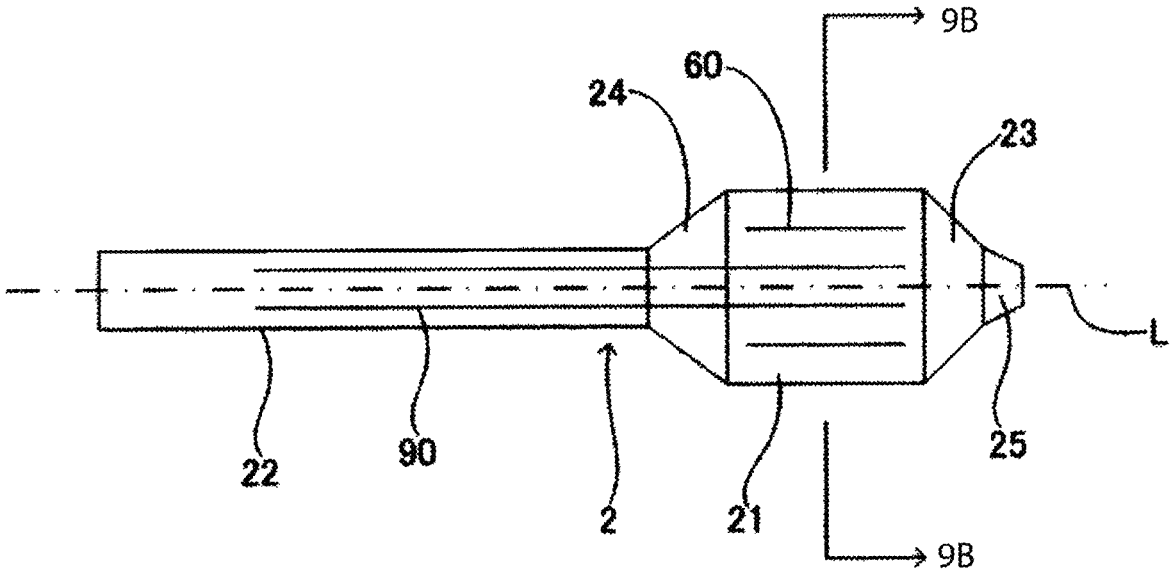
FIG. 9A is a top plan view of another example of an electrode according to second embodiment of the present invention.
Figure 9B:
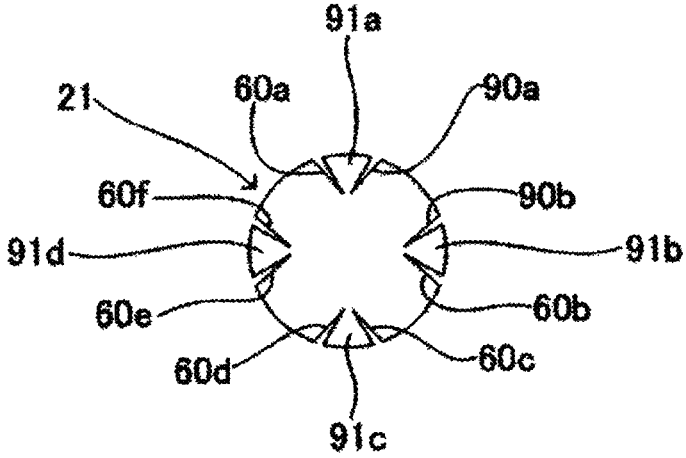
FIG. 9B is a cross sectional view thereof, taken along line 9B-9B of FIG. 9A.

FIGS. 9A and 9B show another example of an electrode according to the second embodiment of the present invention. FIG. 9A is a top plan of the electrode and FIG. 9B is a cross sectional view thereof, taken along a line 9B-9B of FIG. 9. In these figures, the electrode 2 has an electrode main body portion 21, an axis portion 22, taper portions 23 and 24 and a projection portion 25. In the electrode 2 shown in FIG. 9A, two or more grooves 60 which are formed in the electrode main body portion 21 and grooves 90 which are longer in full length than the grooves 60 and which are formed over the electrode main body portion 21, the taper portion 24 and the axis portion 22. The grooves 90 extend in the direction of axis L of the electrode main body portion 21. As shown in FIG. 9B, two or more of pairs of grooves respectively are formed, wherein grooves of each pair are closer to each other as they extend in an inner and diameter direction in each place. A heat retention portion 91 whose shape is a lemon wedge shape in a cross section thereof, taken along the diameter direction, is formed between each pair of adjoining grooves. Specifically, in the example of FIG. 9B, grooves 60*a* and 90*a*, grooves 90*b* and 60*b*, grooves 60*c* and 60*d*, and grooves 60*e* and 60*f* are respectively closer to each other as they extend in the inner and diameter direction of the electrode main body portion 21. A heat retention portion 91*a*, a heat retention portion 91*b*, a heat retention portion 91*c*, a heat retention portion 91*d* are respectively formed between the grooves 60*a* and 90*a*, between the grooves 90*b* and 60*b*, between the grooves 60*c* and 60*d* and between the grooves 60*e* and 60*f*. The heat retention portions 91*a*, 91*b*, 91*c*, and 91*d* are formed at equal intervals in the circumferential direction of a side face of the electrode main body portion 21.

Figure 10:
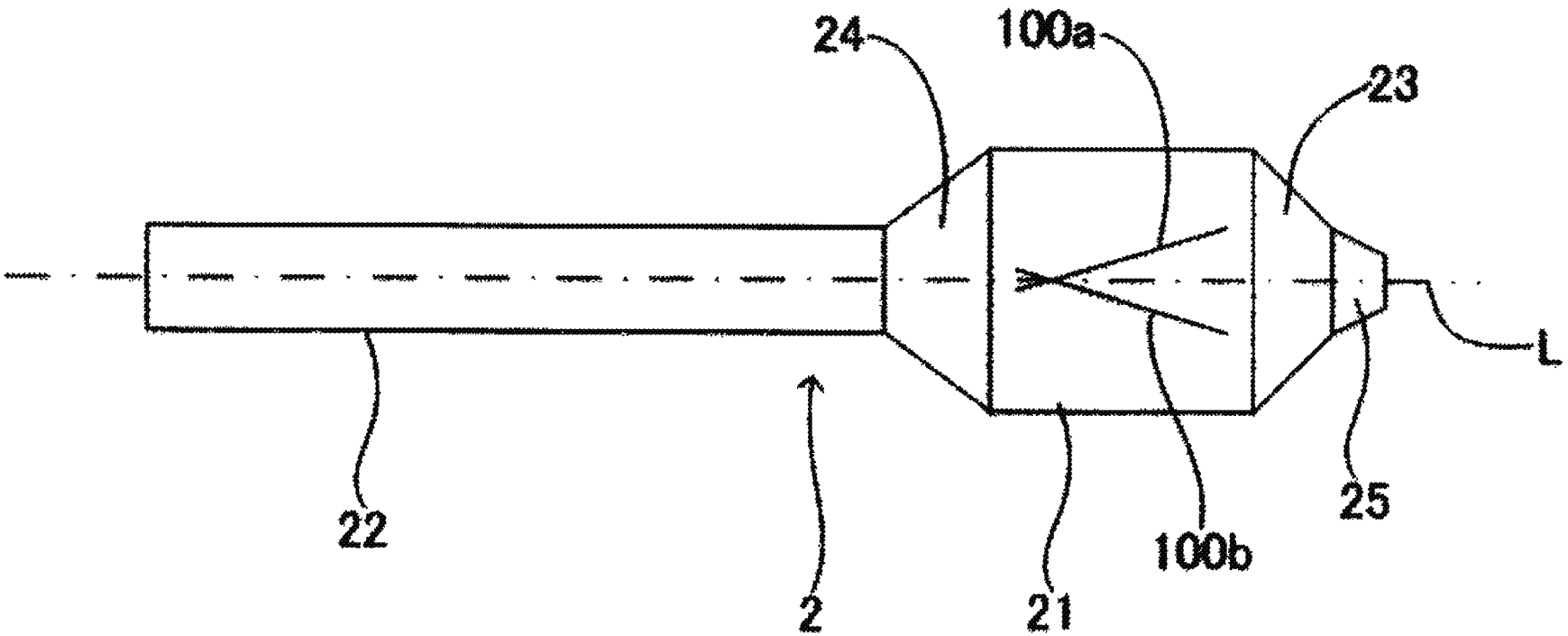
FIG. 10 is a top plan view of another example of an electrode according to the second embodiment of the present invention.

FIG. 10 shows another example of an electrode according to the second embodiment of the present invention. In these figures, the electrode 2 has an electrode main body portion 21, an axis portion 22, taper portions 23 and 24 and a projection portion 25. In the electrode 2 shown in FIG. 10, two or more grooves 100 which extend in parallel with an axis line L of the electrode 2 are formed in the electrode main body portion 21. The grooves 100*a* and 100*b* respectively extend so that they come closer to each other as they approach a base end portion of the electrode main body portion 21 from the tip portion thereof. That is, as grooves 100*a* and 100*b* respectively approach the base end portion of the electrode main body portion 21, they come closer to each other, that is, they extend in an oblique direction with respect to the axis of the electrode 2, and then cross each other at end portions thereof.

Figure 11:
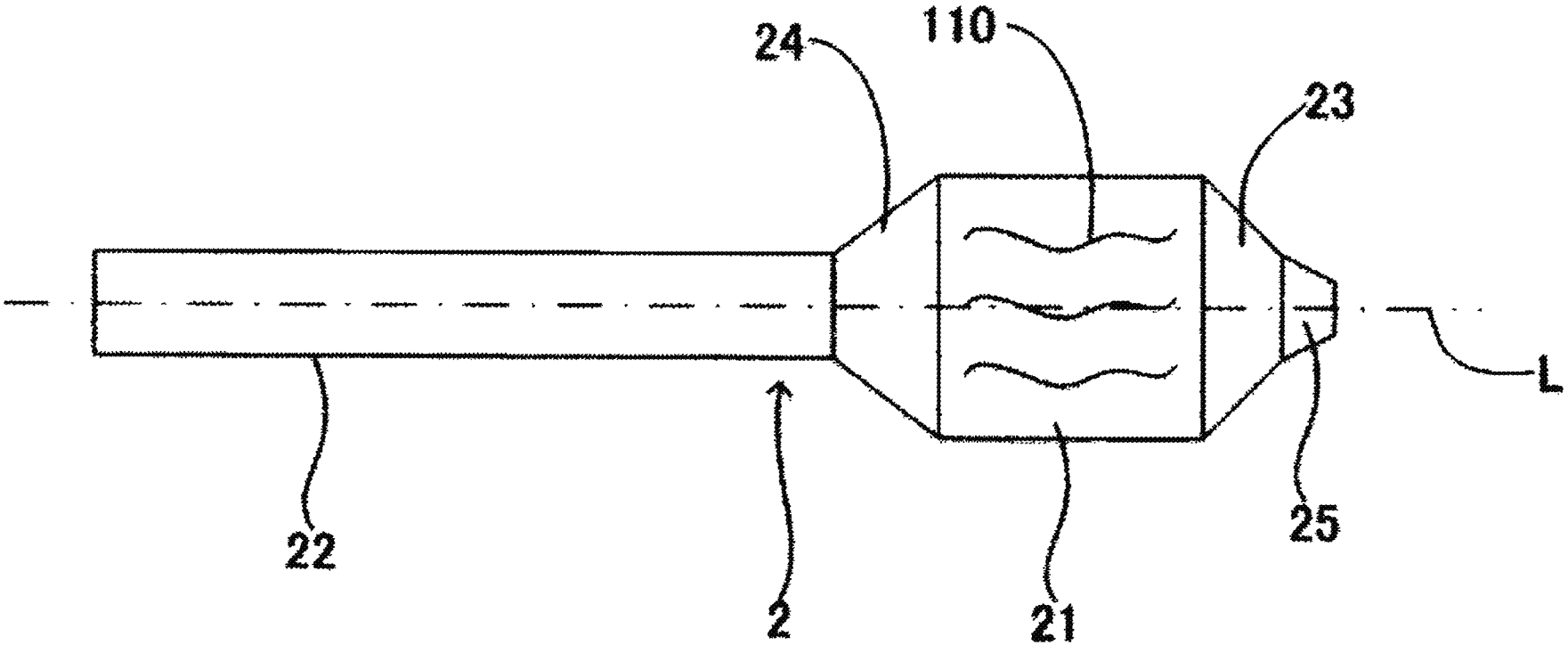
FIG. 11 is a top plan view of still another example of an electrode according to the second embodiment of the present invention.

FIG. 11 shows another example of an electrode according to the second embodiment of the present invention. In these figures, the electrode 2 has an electrode main body portion 21, an axis portion 22, taper portions 23 and 24 and a projection portion 25. In the electrode 2 shown in FIG. 11, two or more grooves 110 which snake their ways along the axis line L of the electrode 2 are formed in the electrode main body portion 21 so as to be apart from one another.

Third Embodiment

Figure 12:
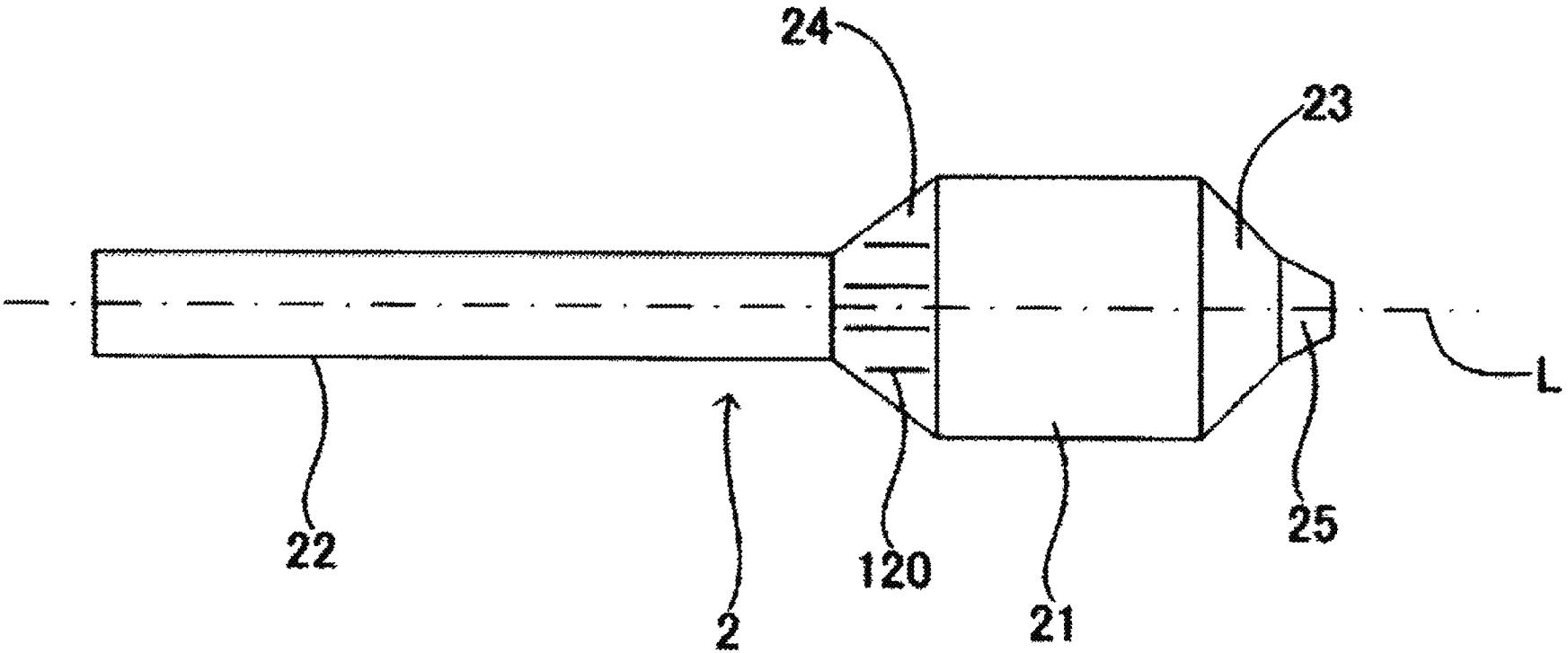
FIG. 12 is a top plan view of an example of an electrode according to a third embodiment of the present invention.

FIG. 12 shows an example of the electrode according to a third embodiment of the present invention. In these figures, the electrode 2 has an electrode main body portion 21, an axis portion 22, taper portions 23 and 24 and a projection portion 25. As shown in FIG. 12, in the electrode 2, two or more grooves 120 which extend in parallel with the axis line L of the electrode 2 are formed so as to be apart from one another in the taper portion 24 in a base end side of the electrode main body portion 21. Since the hollow effect arises due to the groove(s) formed in the taper portion 24 in the electrode 2, and electric discharge moves toward the tip portion of the electrode through the groove(s) of the taper portion 24 located near the base portion of the electrode, electric discharge at the base portion can be suppressed so that it is possible to shorten time required to make transition from the glow discharge to the arc discharge. In addition, as shown in the figure, since the groove(s) 120 which extend along the axis L of the electrode 2 are formed in the taper portion 24, crystal grains are inhibited from growing up in a direction perpendicular to the axis L in the electrode main body portion 21. Therefore, isolated crystal grains are respectively formed in both sides of each groove portion 120 in a cross sectional view thereof, taken in the diameter direction of the taper portion 24. Therefore, fracture strength of the taper portion 24 becomes high, so that it is possible to certainly prevent the electrode from being broken.

Fourth Embodiment

Figure 13:
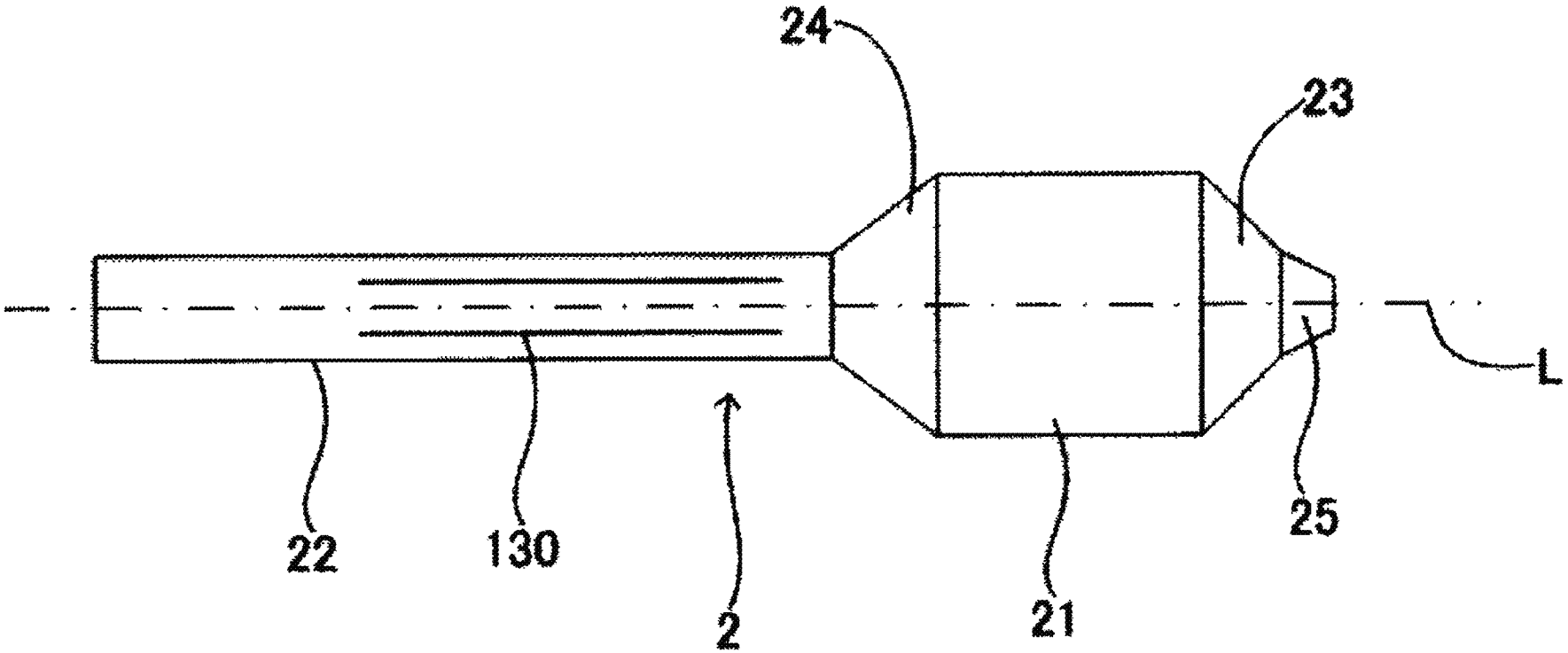
FIG. 13 is a top plan view of an example of an electrode according to a fourth embodiment of the present invention.
Figure 14:
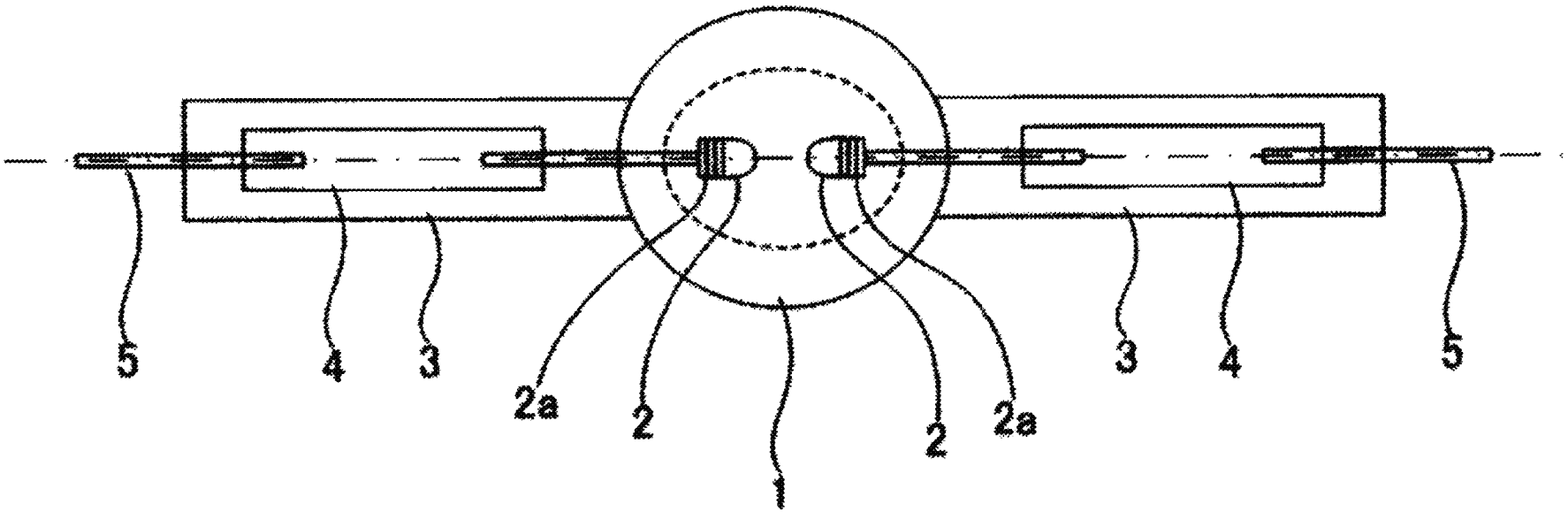
FIG. 14 is a schematic front elevational view of the structure of a short arc type discharge lamp of prior art.

FIG. 13 shows an example of an electrode according to a fourth embodiment of the present invention. In these figures, the electrode 2 has an electrode main body portion 21, an axis portion 22, taper portions 23 and 24 and a projection portion 25. As shown in FIG. 13, two or more grooves 130 which extend in parallel with the axis line L of the electrode 2 are formed so as to be apart from one another in the axis portion 22. Since the hollow effect arises due to the grooves formed in the axis portion in the electrode 2, and electric discharge moves toward the tip portion of the electrode through the groove(s) of the axis portion located near the base portion of the electrode, electric discharge at the base portion can be suppressed so that it is possible to shorten the time required to make transition from the glow discharge to the arc discharge. Moreover, with a temperature rise, it becomes easy for the mercury which enters into sealing portions at the time of starting, to move into an arc tube along the groove(s). Therefore, it is possible to suppress breakage of the sealing portions due to internal pressure rise of the mercury enclosed in the sealing portions. In addition, as shown in the figure, since the groove(s) 130 which extend along the axis L of the electrode 2 are formed, crystal grains are inhibited from growing up in a direction perpendicular to the axis L in the axis portion 22. Therefore, isolated crystal grains are respectively formed at both sides of each groove portion 130 in a cross sectional view thereof, taken in the diameter direction of the axis portion 22. Therefore, fracture (rupture) strength of the axis portion 22 becomes high, so that it is possible to certainly prevent the electrode from being broken.

The preceding description has been presented only to illustrate and describe exemplary embodiments of the present short arc type discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A short arc discharge lamp comprising:

a pair of electrodes, at least one of which has an electrode main body portion and an axis portion, wherein in the at least one of the electrodes, the axis portion has an outer diameter smaller than that of the electrode main body portion, at least one groove extending in an axis line direction of the electrode is formed in the axis portion, isolated crystal grains are formed in the axis line direction along both sides of the groove, a groove depth D is in a range of 20 to 250 μm; and a groove pitch P and the groove depth D satisfies the relationship of $P/D \geqq 0.5$.

2. The short arc discharge lamp according to claim 1, wherein the groove is a V-shape in a cross sectional view thereof, taken in a diameter direction of the electrode.

3. The short arc discharge lamp according to claim 2, wherein a heat retention portion is formed between a pair of the grooves and the heat retention portion is a lemon wedge shape in a cross sectional view thereof, taken in a diameter direction of the electrode.

4. The short arc discharge lamp according to claim 1, wherein the electrodes are made from tungsten of 99.99% or more in purity.

* * * * *